US008431305B2

(12) United States Patent
Kikawa et al.

(10) Patent No.: US 8,431,305 B2
(45) Date of Patent: Apr. 30, 2013

(54) CAPSULE TONER, TWO-COMPONENT DEVELOPER, AND IMAGE FORMING APPARATUS

(75) Inventors: Keiichi Kikawa, Osaka (JP); Yoshiaki Akazawa, Osaka (JP); Yoshitaka Kawase, Osaka (JP); Yoritaka Tsubaki, Osaka (JP); Yoshinori Mutoh, Osaka (JP); Takashi Hara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 495 days.

(21) Appl. No.: 12/707,028

(22) Filed: Feb. 17, 2010

(65) Prior Publication Data

US 2010/0209145 A1 Aug. 19, 2010

(30) Foreign Application Priority Data

Feb. 17, 2009 (JP) ..... P2009-034568

(51) Int. Cl.
*G03G 9/00* (2006.01)

(52) U.S. Cl.
USPC ..... 430/110.2; 430/108.1; 430/109.3; 430/109.4

(58) Field of Classification Search ..... 430/108.1, 430/109.1, 109.3, 109.4, 110.2
See application file for complete search history.

(56) References Cited

U.S. PATENT DOCUMENTS

| | | | | |
|---|---|---|---|---|
| 5,334,471 | A * | 8/1994 | Sacripante et al. | 430/106.2 |
| 2004/0191659 | A1 | 9/2004 | Nakamura et al. | |
| 2006/0093945 | A1 * | 5/2006 | Dalzell et al. | 430/109.1 |
| 2007/0202427 | A1 * | 8/2007 | Tanaka | 430/110.2 |
| 2007/0218393 | A1 * | 9/2007 | Nozaki et al. | 430/110.2 |
| 2009/0011357 | A1 | 1/2009 | Kawase et al. | |
| 2009/0297975 | A1 * | 12/2009 | Ishikawa et al. | 430/109.4 |
| 2010/0159374 | A1 * | 6/2010 | Mutoh et al. | 430/105 |

FOREIGN PATENT DOCUMENTS

| | | |
|---|---|---|
| JP | 07-116499 | 5/1995 |
| JP | 2000-147829 | 5/2000 |
| JP | 2004-184719 A | 7/2004 |
| JP | 2007-199314 | 8/2007 |
| JP | 2009-14757 A | 1/2009 |
| JP | 2009-15175 A | 1/2009 |

* cited by examiner

*Primary Examiner* — Stewart Fraser
(74) *Attorney, Agent, or Firm* — Nixon & Vanderhye P.C.

(57) ABSTRACT

A capsule toner capable of enhancing low temperature fixation property without impairing preservation property under a high temperature environment, a two-component developer, and an image forming apparatus are provided. The capsule toner is constituted of toner particles having toner base particles and a coating layer for coating the surface thereof. The toner base particle includes styrene-acrylic resin or polyester resin as a binder resin, and the coating layer includes styrene-acrylic resin or polyester resin. The capsule toner contains 0.05% by weight or more and 0.70% by weight or less of volatile plasticizer based on a total amount of the capsule toner.

3 Claims, 6 Drawing Sheets

CAPSULE TONER, TWO-COMPONENT DEVELOPER, AND IMAGE FORMING APPARATUS

CROSS-REFERENCE TO RELATED APPLICATION

This application claims priority to Japanese Patent Application No. 2009-034568, which was filed on Feb. 17, 2009, the contents of which are incorporated herein by reference in their entirety.

BACKGROUND OF THE INVENTION

1. Field of the Invention

The present invention relates to a capsule toner, a two-component developer, and an image forming apparatus.

2. Description of the Related Art

In recent years, there has been interest in energy conservation and reduction of $CO_2$ from the aspect of environmental conservation and the like.

An electrophotographic image forming apparatus is also no exception and it has been desired to reduce power consumption of the image forming apparatus by decreasing a fixation temperature of a toner onto a recording medium than in the conventional manner. Further, in order to achieve high-speed printing, reduction in fixation time and low temperature fixation have been required.

In order to realize low temperature fixation, there has been proposed a method for decreasing a flow tester softening temperature and a glass transition temperature of a binder resin which is an essential constituent of toner constituents. However, when trying to decrease the softening temperature and the glass transition temperature of the binder resin, since preservation stability of the toner decreases accordingly, fusion and adhesion of the toner easily occur in the standstill state at a high temperature and the high-stress state in a cartridge.

In order to solve the problem, it is necessary to maintain preservation stability of toner particles including a binder resin whose flow tester softening temperature and glass transition temperature are low. Thus, there is proposed an encapsulated toner in which toner base particles are coated with a coating layer having high flow tester softening temperature and glass transition temperature.

For example, Japanese Unexamined Patent Publication JP-A 2000-147829 discloses microcapsule toner particles achieving both low temperature fixation and preservation stability, which is constituted of a core material including a binder resin having a glass transition temperature of from −20 to 60° C. and an outer shell material including a binder resin having a glass transition temperature of from 60 to 180° C.

However, since the toner of the JP-A 2000-147829 uses resin having low glass transition temperature as a core material, when stacked printed matters are left under a high temperature environment such as in an automobile subjected to direct sunlight or when printed matters are discharged and stacked on a discharge tray, there poses a problem that a toner image is fused and adhered so that printed matters are adhered to each other. In order to avoid the problem, when resin having high glass transition temperature is used as the toner base particles serving as the core material, there poses a problem that it is impossible to enhance low temperature fixation property.

SUMMARY OF THE INVENTION

An object of the invention is to provide a capsule toner which solves at once the contradictory problems described above and which is capable of enhancing low temperature fixation property without impairing preservation property under a high temperature environment, a two-component developer, and an image forming apparatus.

The invention provides a capsule toner comprising toner particles having toner base particles including styrene-acrylic resin or polyester resin as a binder resin, and a coating layer including styrene-acrylic resin or polyester resin, for coating a surface of the toner base particles, 0.05% by weight or more and 0.70% by weight or less of volatile plasticizer being contained based on a total amount of the capsule toner.

According to the invention, when a predetermined amount of plasticizer is contained in the capsule toner, it is possible to decrease a softening temperature of capsule toner particles and to enhance low temperature fixation property. In addition, by using the volatile plasticizer, the plasticizer concentration in a surface layer part of the capsule toner is reduced and aggregation of capsule toner particles is suppressed so that preservation stability is enhanced. Further, when the plasticizer is volatilized on a surface of a toner image after heating and fixation, it is possible to suppress fusion and adhesion of printed matters and preservation property of a printed image is improved.

Further, in the invention, it is preferable that the volatile plasticizer is alcohol whose boiling point is 78° C. or higher and 98° C. or lower.

Further, according to the invention, since alcohol whose boiling point is 78° C. or higher and 98° C. or lower, that is, ethanol (boiling point:78.3° C.), n-propanol (boiling point: 97.2° C.), or iso-propanol (boiling point: 82.4° C.) has not so high affinity for styrene-acrylic resin or polyester resin, volatilization easily occurs from the surface layer part of the capsule toner, fusion and adhesion property of the surface layer part of the capsule toner is suppressed, and preservation stability of the capsule toner is enhanced. In addition, when the volatile plasticizer is volatilized immediately from the surface of the toner image after heating and fixation, it is possible to suppress fusion and adhesion of printed matters on a discharge tray.

Further, in the invention, it is preferable that the volatile plasticizer is ethanol.

According to the invention, since ethanol has low toxicity to the human body, it is possible to suppress adverse effect on the human body even when volatilization gradually occurs from the surface of the toner image at the time of fixation or after printing.

Further, the invention provides a two-component developer comprising the capsule toner mentioned above and a carrier having magnetism.

According to the invention, since the capsule toner which is excellent in low temperature fixation property and is hard to aggregate is included, it is possible to obtain a two-component developer excellent in low temperature fixation property without impairing fluidity.

Further, the invention provides an image forming apparatus, comprising:

a photoreceptor drum;

a charging device which charges a surface of the photoreceptor drum;

an exposure device which forms an electrostatic latent image on a surface of the photoreceptor drum;

a developing device which accommodates the capsule toner mentioned above and develops the electrostatic latent image formed on the surface of the photoreceptor drum with the capsule toner to thereby form a toner image;

a transfer device which transfers the toner image to a recording medium; and a fixing device which fixes the transferred toner image onto the recording medium.

According to the invention, the use of the capsule toner which is excellent in low temperature fixation property and preservation stability makes it possible to obtain sufficient fixation property even when a fixation temperature is low and to realize energy conservation. In addition, since the developer has high preservation stability, it is possible to provide a stable image even under a relatively high temperature environment.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
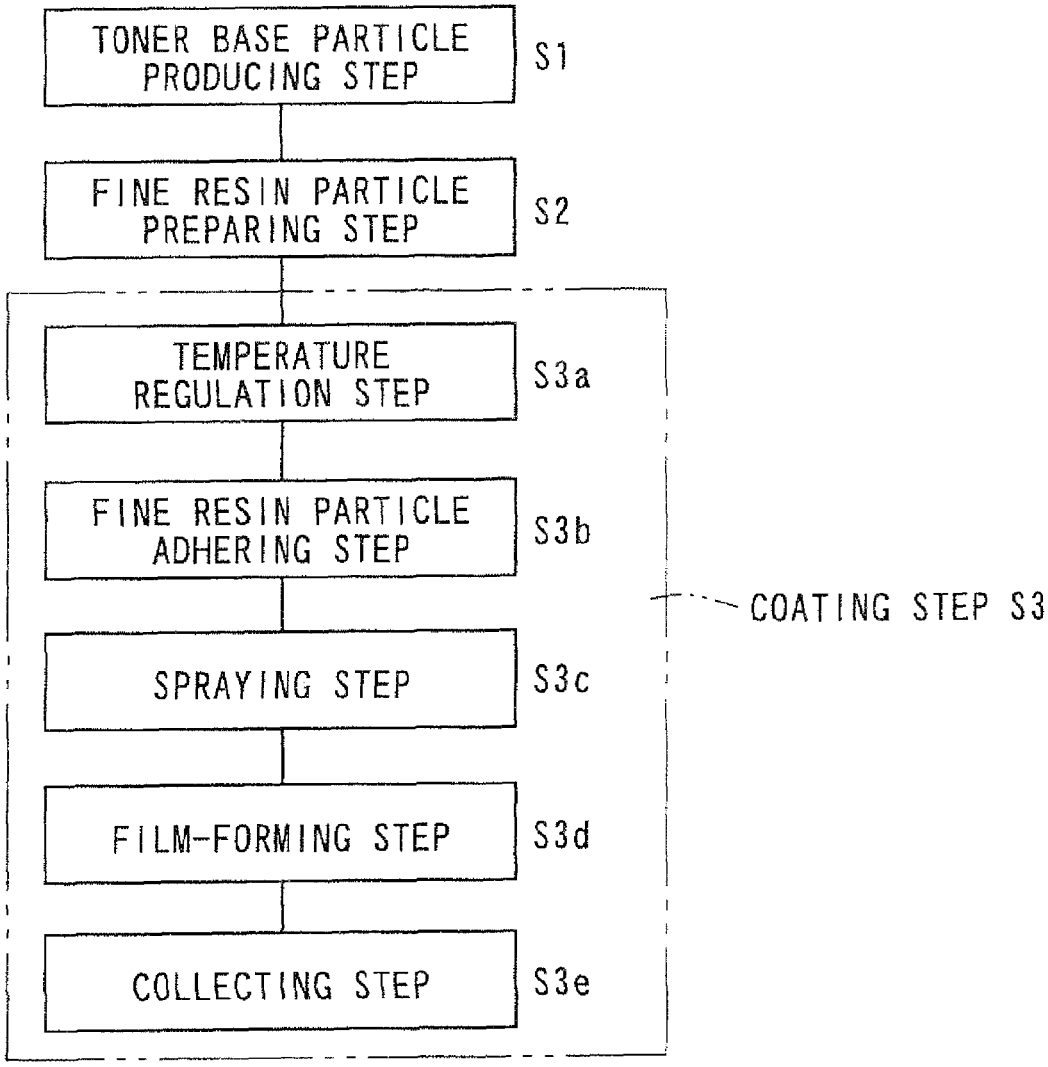
FIG. 1 is a flowchart of an example of a procedure for a method for manufacturing a toner according to an embodiment of the invention.

Now referring to the drawings, preferred embodiments of the invention are described below.

1. Method for Manufacturing Toner

FIG. 1 is a flowchart of an example of a procedure for a method for manufacturing to obtain a capsule toner according to the invention. The method for manufacturing a capsule toner includes a toner base particle producing step S1 of producing toner base particles, a fine resin particle preparing step S2 of preparing fine resin particles, and a coating step S3 of coating the toner base particle with the fine resin particles.

(1) Toner Base Particle Producing Step S1

In the toner base particle producing step S1, toner base particles to be coated with a resin layer are produced. The toner base particles are particles each containing a binder resin and a colorant and can be obtained with a known method without particular limitation to a production method thereof. Examples of the method for producing toner base particles include dry methods such as pulverization methods, and wet methods such as suspension polymerization methods, emulsion aggregation methods, dispersion polymerization methods, dissolution suspension methods and melting emulsion methods. The method for producing toner base particles using a pulverization method will be described below.

(Method for Producing Toner Base Particles by a Pulverization Method)

In a method for producing toner base particles using a pulverization method, a toner composition containing a binder resin, a colorant and other additives is dry-mixed by a mixer, and thereafter melt-kneaded by a kneading machine. The kneaded material obtained by melt-kneading is cooled and solidified, and then the solidified material is pulverized by a pulverizing machine. Subsequently, the toner base particles are optionally obtained by conducting adjustment of a particle size such as classification.

Usable mixers include heretofore known mixers including, for example, Henschel-type mixing devices such as HENSCHEL MIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roil-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force or classification with a wind force is usable and an example thereof includes a revolving type wind-force classifying machine (rotary type wind-force classifying machine).

(Raw Materials of Toner Base Particles)

As described above, the toner base particles each contain the binder resin and the colorant. The binder resin is not particularly limited and any known binder resin used for a black toner or a color toner is usable, and examples thereof include a styrene resin such as a polystyrene and a styrene-acrylic acid ester copolymer resin, an acrylic resin such as a polymethylmethacrylate, a polyolefin resin such as a polyethylene, a polyester, a polyurethane, and an epoxy resin. Further, a resin obtained by polymerization reaction induced by mixing a monomer mixture material and a release agent may be used. The binder resin may be used each alone, or two or more of them may be used in combination.

Among the binder resins, polyester is preferable as binder resin for color toner owing to its excellent transparency as well as good powder flowability, low-temperature fixing property, and secondary color reproducibility. For polyester, heretofore known substances may be used including a polycondensation of polybasic acid and polyvalent alcohol.

For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination.

For polyvalent alcohol, substances known as monomers for polyester can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic dials such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction in an ordinary manner, that is, for example, the polybasic acid and the polyvalent alcohol are brought into contact with each other in the presence or absence of the organic solvent using the polycondensation catalyst. The polycondensation reaction ends when an acid number, a softening temperature, and the like of the polyester to be produced reach predetermined values. The polyester is thus obtained.

When the methyl-esterified compound of the polybasic acid is used as part of the polybasic acid, dimethanol polycondensation reaction is caused. In the polycondensation reaction, a compounding ratio, a reaction rate, and the like of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester self-dispersible having self-dispersibility in water may also be used which polyester has at least one of a main chain and side chain bonded to a hydrophilic radical such as a carboxyl group or a sultanate group. Further, polyester may be grafted with acrylic resin.

It is preferred that the binder resin have a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition temperature higher than 80° C. lowers the fixing property of the toner onto a recording medium, which may cause a fixing failure.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GE, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green G, and C.I. pigment green 7.

Examples of white colorant include those compounds such as zinc oxide, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

The colorant may be used as a masterbatch to be dispersed uniformly in the binder resin. Further, two or more kinds of the colorants may be formed into a composite particle. The composite particle is capable of being manufactured, for example, by adding an appropriate amount of water, lower alcohol and the like to two or more kinds of colorants and granulating the mixture by a general granulating machine such as a high-speed mill, followed by drying. The masterbatch and the composite particle are mixed into the toner composition at the time of dry-mixing.

The toner base particles may contain a charge control agent in addition to the binder resin and the colorant. For the charge control agent, charge control agents commonly used in this field for controlling a positive charge and a negative charge are usable.

Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap.

The charge control agents may be used each alone, or optionally two or more of them may be used in combination. Although the amount of the charge control agent to be used is not particularly limited and can be properly selected from a wide range, 0.5 parts by weight or more and 3 parts by weight or less is preferably used based on 100 parts by weight of the binder resin.

Further, the toner base particles may contain a release agent in addition to the binder resin and the colorant. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, and the like) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

The toner base particles obtained at the toner base particle producing step S1 preferably have a volume average particle size of 4 μm or more and 8 μm or less. In a case where the volume average particle size of the toner base particles is 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. In a case where the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. In a case where the volume average particle size of the toner base particles exceeds 8 μm, the particle size of the toner base particles becomes large and the layer thickness of a formed image is increased so that an image with remarkable granularity is generated and the high-definition image is not obtainable, which is undesirable. In addition, as the particle size of the toner base particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Pine Resin Particle Preparing Step

At the fine resin particle preparing step S2, dried fine resin particles are prepared. Any method may be used for the drying method and it is possible to obtain the dried fine resin particles by using methods such as drying of a hot air receiving type, drying of heat transfer by heat conduction type, far infrared radiation drying, and microwave drying. The fine resin particles are used as a material for forming a film on the toner base particles at the subsequent coating step S3. By using the fine resin particles as the film-forming material on the surface of the toner base particles, for example, it is possible to prevent generation of aggregation due to melting of low-melting point components such as a release agent contained in the toner base particles during storage. Further, in a case where the liquid in which the fine resin particles are dispersed is sprayed to coat the toner base particles, the shape of the fine resin particles remain on the surface of the toner base particles, and therefore, it is possible to obtain a toner excellent in a cleaning property compared to a toner with a flat surface.

The fine resin particles as described above can be obtained, for example, in a manner that raw materials of the fine resin particles are emulsified and dispersed into fine grains by using a homogenizer or the like machine. Further, the fine resin particles can also be obtained by polymerizing monomers.

For the resin used for raw materials of the fine resin particles, a resin used for materials of a toner is usable and examples thereof include a polyester, an acrylic resin, a styrene resin, and a styrene-acrylic copolymer. Among the resins exemplified above, the fine resin particles preferably contain an acrylic resin and a styrene-acrylic copolymer. The acrylic resin and the styrene-acrylic copolymer have many advantages such that the strength is high with light weight, transparency is high, the price is low, and materials having a uniform particle size are easily obtained.

Although the resin used for raw materials of the fine resin particles may be the same kind of resin as the binder resin contained in the toner base particles or may be a different kind of resin, the different kind of resin is preferably used in view of performing the surface modification of the toner. When the different kind of resin is used as the resin used for the raw materials of the fine resin particles, a softening temperature of the resin used for the raw materials of the fine resin particles is preferably higher than a softening temperature of the binder resin contained in the toner base particles. This makes it possible to prevent toners manufactured with the manufacturing method of this embodiment from being fused each other during storage and to improve storage stability. Further, the softening temperature of the resin used for the raw materials of the fine resin particles depends on an image forming apparatus in which the toner is used, but is preferably 80° C. or higher and 140° C. or lower. By using the resin in such a temperature width, it is possible to obtain the toner having both the storage stability and the fixing performance.

The volume average particle size of the fine resin particles needs to be sufficiently smaller than the average particle size of the toner base particles, and is preferably 0.05 μm or more and 1 μm or less. More preferably, the volume average particle size of the fine resin particles is 0.1 μm or more and 0.5 μm or less. In a case where the volume average particle size of the fine resin particles is 0.05 μm or more and 1 μm or less, a projection with a suitable size is formed on the surface of the coating layer. Whereby, the toner manufactured with the manufacturing method of this embodiment is easily caught by cleaning blades at the time of cleaning, resulting in improvement of the cleaning property.

(3) Coating Step S3

<Toner Manufacturing Apparatus>

Figure 2:
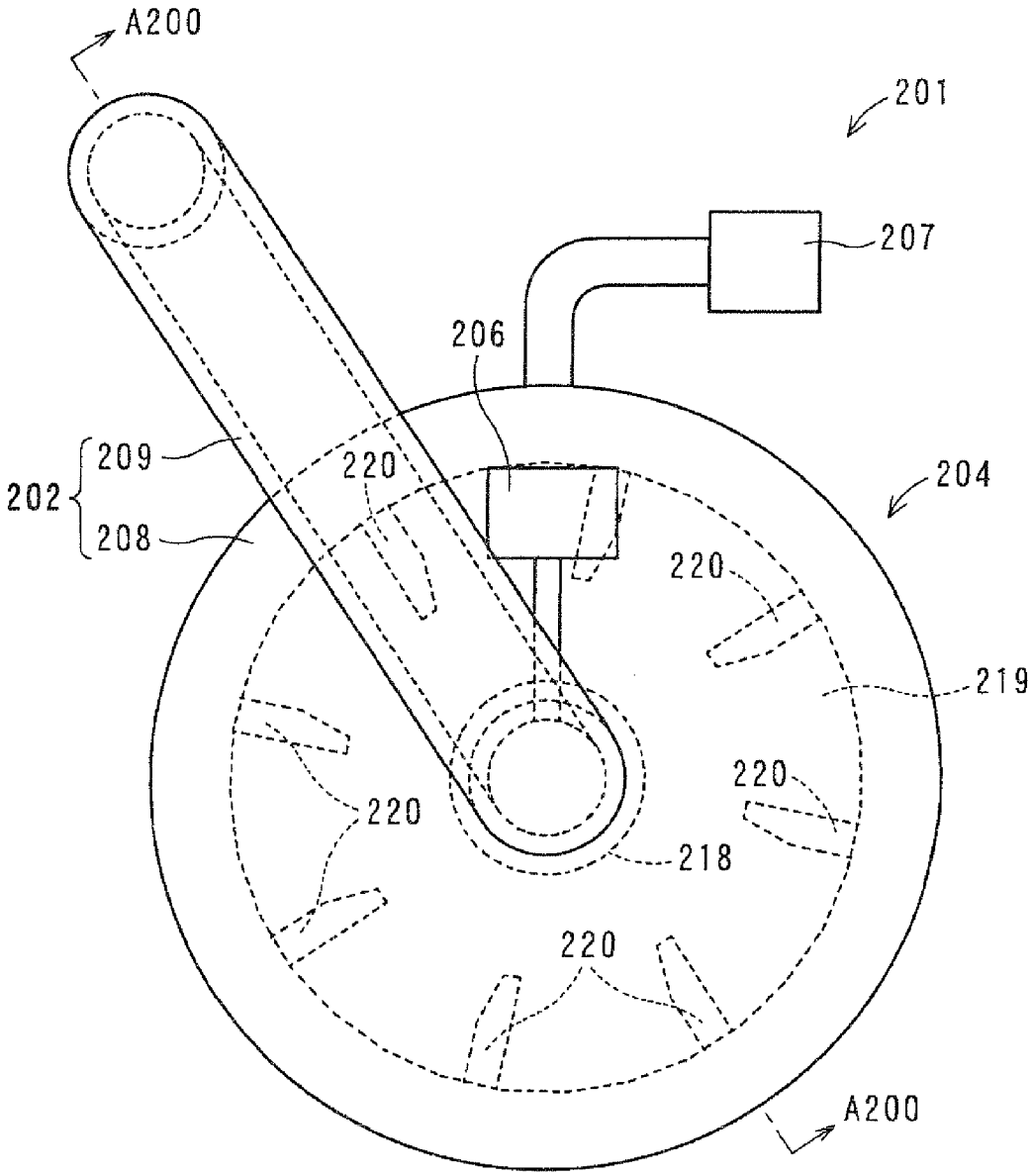
FIG. 2 is a front view of a configuration of a toner manufacturing apparatus.
Figure 3:
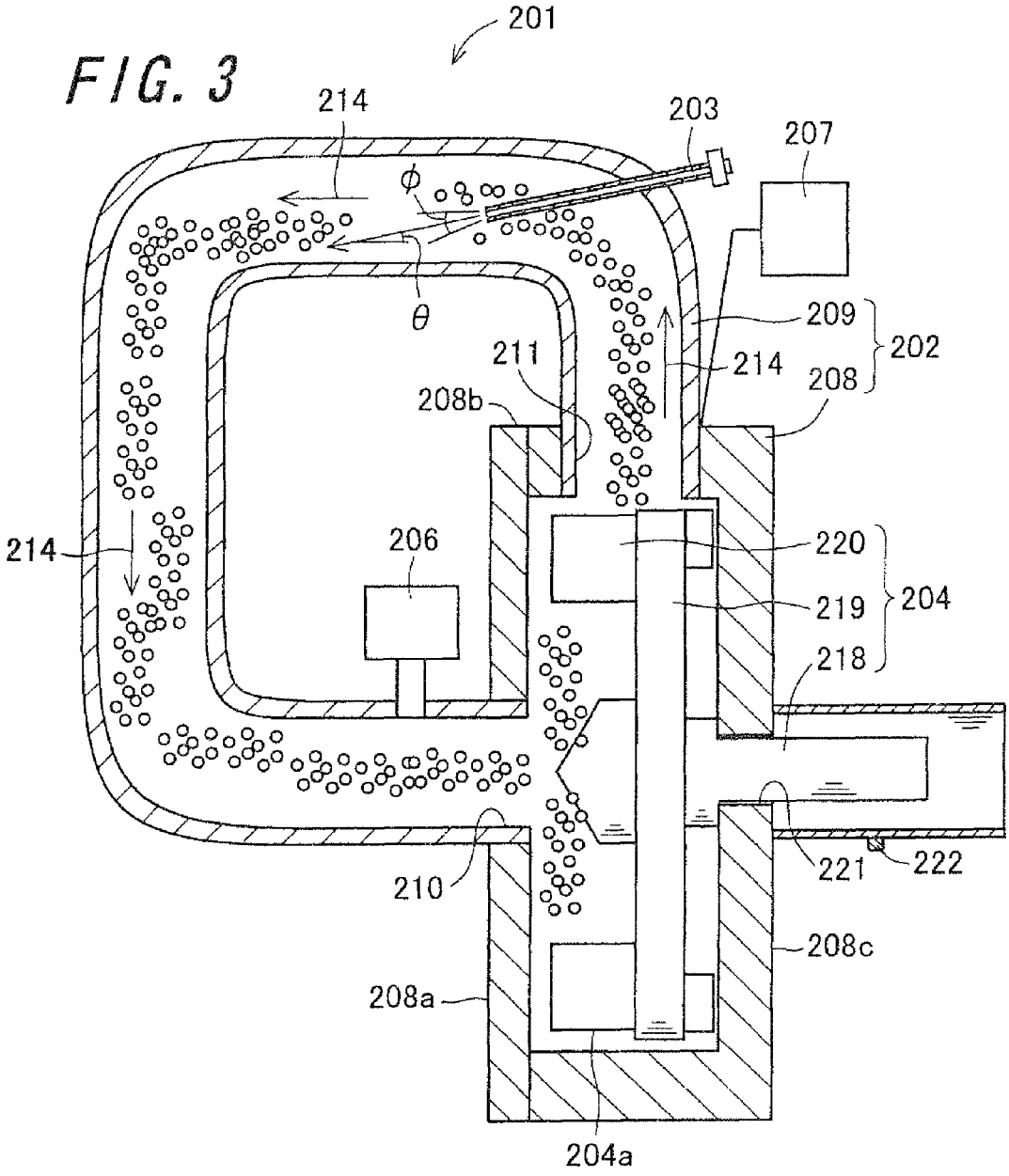
FIG. 3 is a schematic sectional view of the toner manufacturing apparatus shown in FIG. 2 taken along the cross-sectional line A200-A200.

FIG. 2 is a front view of a configuration of a toner manufacturing apparatus 201 used for manufacturing a capsule toner which is an embodiment of the invention. FIG. 3 is a schematic sectional view of the toner manufacturing apparatus 201 shown in FIG. 2 taken along the cross-sectional line A200-A200. The toner manufacturing apparatus 201 is a rotary stirring apparatus and is comprised of a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section. At the coating step S3, for example, by using the toner manufacturing apparatus 201 shown in FIG. 2, the mixture of fine particles prepared at the fine resin particle preparing step S2 are adhered to the toner base particles produced at the toner base particle producing step S1 to form a resin film on the toner base particles with an impact force by a multiplier effect of circulation and stirring in the apparatus.

(Powder Passage)

The powder passage 202 is comprised of a stirring section 208 and a powder flowing section 209. The stirring section 208 is a cylindrical container-like member having an internal space. Opening sections 210 and 211 are formed in the stirring section 208 which is a rotary stirring chamber. The opening section 210 is formed at an approximate center part of a surface 208*a* in one side of the axial direction of the stirring section 208 so as to penetrate a side wall including the surface 208*a* of the stirring section 208 in the thickness direction. Moreover, the opening section 211 is formed at a side surface 208*b* perpendicular to the surface 208*a* in one side of the axial direction of the stirring section 208 so as to penetrate a side wall including the side surface 208*b* of the stirring section 208 in the thickness direction. The powder flowing section 209 which is a circulation tube has one end connected to the opening section 210 and the other end connected to the opening section 211. Whereby, the internal space of the stirring section 208 and the internal space of the powder flowing section 209 are communicated to form the powder passage 202. The toner base particles, the fine resin particles and gas flow through the powder passage 202. The powder passage 202 is provided so that a powder flowing direction which is a direction in which the toner base particles and the fine resin particles flow is constant.

A temperature in the powder passage 202 is set at a glass transition temperature of the toner base particles or less and is more preferably 30° C. or higher. The temperature in the powder passage 202 is almost uniform at any part by fluidity of the toner base particles. In a case where the temperature in the passage exceeds the glass transition temperature of the toner base particles, there is a possibility that the toner base particles are softened excessively and aggregation of the toner base particles is generated. Further, in a case where the temperature is lower than 30° C., the drying speed of a dispersion liquid is made slow and the productivity is lowered. Accordingly, in order to prevent aggregation of the toner base particles, it is necessary that the temperature of the powder passage 202 and the rotary stirring section 204, which will be described below, is maintained at the glass transition temperature of the toner base particles or less. Thus, the temperature regulation jacket, which will be described below, whose inner diameter is larger than an external diameter of the powder passage tube is disposed at least on a part of the outside of the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted in a through-hole 221 penetrating a side wall including a surface 208*c* in a thickness direction thereof, and that is rotated around the axis by a motor (not shown). The rotary disc 219 is a discotic member having the axis supported by the rotary shaft member 218 so as to match the axis of the rotary shaft member 218 and rotating with rotation of the rotary shaft member 218. The plurality of stirring blades 220 are supported by the peripheral edge of the rotary disc 219 and are rotated with rotation of the rotary disc 219.

At the coating step S3 described below, the peripheral speed of the outermost peripheral of the rotary stirring section 204 is preferably set to 30 m/sec or more, and more preferably to 50 m/sec or more. The outermost peripheral of the rotary stirring section 204 is a part 204*a* of the rotary stirring section 204 that has the longest distance from the axis of the rotary shaft member 218 in the direction perpendicular to the extending direction of the rotary shaft member 218 of the rotary stirring section 204. In a case where the peripheral speed in the outermost peripheral of the rotary stirring section 204 is at 30 m/sec or more at the time of rotation, it is possible to isolate and fluidize the toner base particles. In a case where the peripheral speed in the outermost peripheral is less than 30 m/sec, it is impossible to isolate and fluidize the toner base particles and the fine resin particles, thus making it impossible to uniformly coat the toner base particles with the resin film.

The toner base particles and the fine resin particles preferably collide with the rotary disc 219 perpendicularly to the rotary disc 219. This makes it possible to stir the toner base particles and the fine resin particles sufficiently and coat the toner base particles with the fine resin particles more uniformly, and to further improve yield of the capsule toner with the uniform coating layer.

(Spraying Section)

The spraying section 203 is provided so as to be inserted in an opening formed on the outer wall of the powder passage 202 and is provided, in the powder flowing section 209, on the powder flowing section which is on the closest side to the opening section 211 in the flowing direction of the toner base particles and the fine resin particles. The spraying section 203 includes a liquid reservoir for reserving a liquid, a carrier gas supplying section for supplying carrier gas, and a two-fluid nozzle for mixing the liquid and the carrier gas, ejecting the obtained mixture to the toner base particles present in the powder passage 202, and spraying droplets of the liquid to the toner base particles. For the carrier gas, compressed air or the like is usable. The two-fluid nozzle has a structure that a liquid tube and an air tube are partially connected so as not to shift the center thereof, and sprays the liquid at a constant speed to keep the concentration in the powder passage constant. By a multiplier effect of the circulating section and the temperature regulation section, the fine resin particles are plasticized so that the toner having uniform film quality and particle size is able to be obtained. Further, by disposing a projected-shape cap for preventing adhesion of the toner base particles and the fine resin particles in an ejecting zone of the liquid and the compressed air of the nozzle, the effect thereof is enhanced to allow manufacturing in high yield.

(Temperature Regulation Jacket)

The temperature regulation jacket (not shown) which is a temperature regulation section is provided at least on a part of the outside of the powder passage 202 and regulates the temperature in the powder passage 202 and of the rotary stirring section 204 to a predetermined temperature by passing a cooling medium or a heating medium through the space inside the jacket. Whereby, at the spraying step S3*c* and the film-forming step S3*d*, which will be described below, a variation in the temperature applied to the toner base particles, the fine resin particles, and the liquid is reduced and this makes it possible to keep the stable fluid state of the toner base particles and the fine resin particles. In this embodiment, the temperature regulation jacket is preferably provided over the entire outside of the powder passage 202.

Although the toner base particles and the fine resin particles generally collide with the inner wall of the powder passage many times, a part of the collision energy is converted into the thermal energy at the time of collision and is accumulated in the toner base particles and the fine resin particles. As the number of the collision increases, the thermal energy accumulated in the particles increases and then the toner base particles and the fine resin particles are softened to be adhered to the inner wall of the powder passage. By providing the temperature regulation jacket over the entire outside of the powder passage 202, an adhesive force of the toner base particles and the fine resin particles is reduced to the inner wall of the powder passage, it is possible to prevent adhesion of the toner base particles to the inner wall of the powder passage 202 due to a sudden rise of the temperature in the apparatus reliably and to avoid that the inside of the powder passage is narrowed by the toner base particles and the fine resin particles. Accordingly, the toner base particles are coated with the fine resin particles uniformly and it is possible to manufacture a toner having excellent cleaning property in high yield.

In the inside of the powder flowing section 209 downstream of the spraying section 203, the substance in liquid form sprayed is not dried and remains therein. Where the temperature is not appropriate, drying rate becomes slow, and the substance in liquid form easily remains. Where the toner base particles are in contact with the residual liquid, the toner base particles are easily adhered to the inner wall of the powder passage 202. This may be the generation source of aggregation of the toner base particles. On the inner wall in the vicinity of the opening 210, the toner base particles flowing into the stirring section 208 collide with the toner base particles fluidized in the stirring section 208 by the stirring with the rotary stirring section 204. By this, the toner base particles collided are easily adhered to the vicinity of the opening 210. Therefore, adhesion of the toner base particles to the inner wall of the powder passage 202 can further securely be prevented by providing the temperature regulation jacket in an area to which the toner base particles are easily adhered.

(Powder Inputting Section and Powder Collecting Section)

Figure 4:
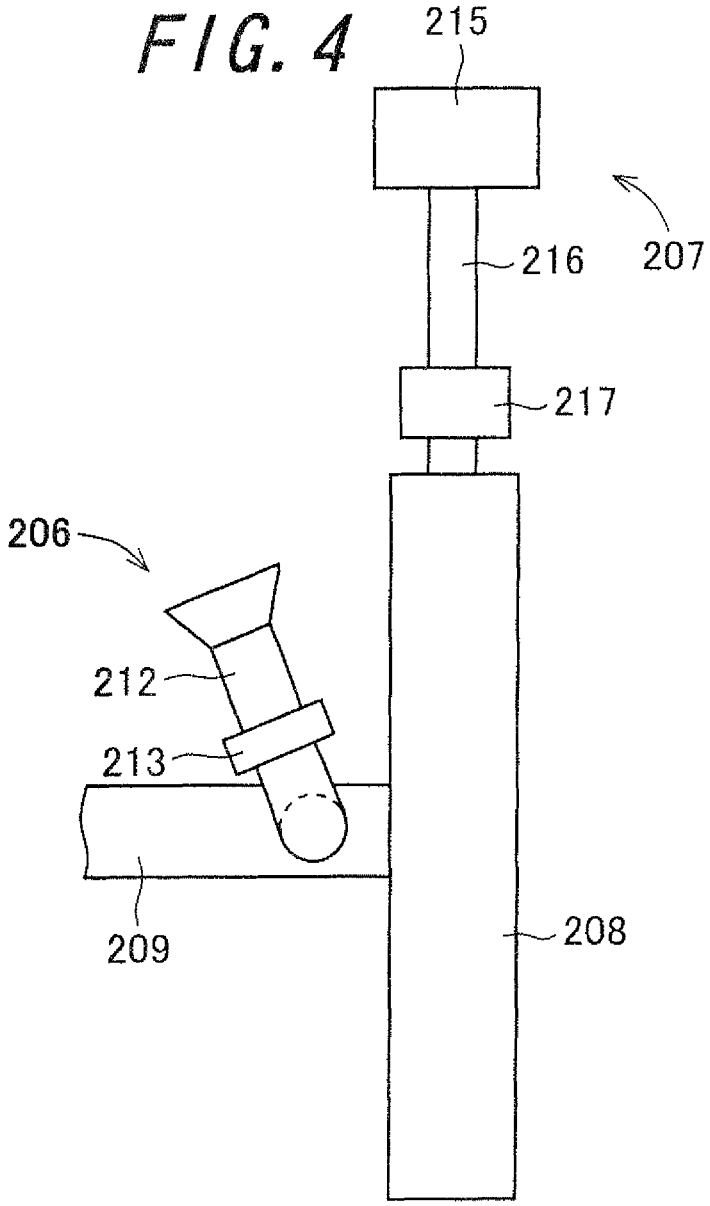
FIG. 4 is a front view of a configuration around the powder inputting section and the powder collecting section.

The powder flowing section 209 of the powder passage 202 is connected to the powder inputting section 206 and the powder collecting section 207. FIG. 4 is a front view of a configuration around the powder inputting section 206 and the powder collecting section 207.

The powder inputting section 206 includes a hopper (not shown) that supplies the toner base particles and the fine resin particles, a supplying tube 212 that communicates the hopper and the powder passage 202, and an electromagnetic valve 213 provided in the supplying tube 212. The toner base particles and the fine resin particles supplied from the hopper are supplied to the powder passage 202 through the supplying tube 212 in a state where the passage in the supplying tube 212 is opened by the electromagnetic valve 213. The toner base particles and the fine resin particles supplied to the powder passage 202 flow in the constant powder flowing direction with stirring by the rotary stirring section 204. Moreover, the toner base particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage it the collecting tube 216 is closed by the electromagnetic valve 217.

The coating step S3 using the toner manufacturing apparatus 201 as described above includes a temperature regulation step S3*a*, a fine resin particle adhering step S3*b*, a spraying step S3*c*, a film-forming step S3*d*, and a collecting step S3*e*.

(3)-1 Temperature Regulation Step S3*a*

At the temperature regulation step S3*a*, while the rotary stirring section 204 is rotated, temperatures in the powder passage 202 and of the rotary stirring section 204 are regulated to a predetermined temperature by passing a medium through the temperature regulation jacket disposed on the outside thereof. This makes it possible to control the temperature in the powder passage 202 at not higher than a temperature at which the toner base particles and the fine resin particles that are inputted at the fine resin particle adhering step S3*b* described below are not softened and deformed.

(3)-2 Fine Resin Particle Adhering Step S3*b*

At the fine resin particle adhering step S3*b*, the toner base particles and the fine resin particles are supplied from the powder inputting section 206 to the powder passage 202 in a state where the rotary shaft member 218 of the rotary stirring section 204 is being rotated. The toner base particles and the fine resin particles supplied to the powder passage 202 are stirred by the rotary stirring section 204 to flow through the powder flowing section 209 of the powder passage 202 in the direction indicated by an arrow 214. Whereby, the fine resin particles are adhered to the surface of the toner base particles.

(3)-3 Spraying Step S3*c*

At the spraying step S3*c*, the toner base particle and the fine resin particles in a fluidized state is sprayed with a liquid having an effect of plasticizing the particles without dissolving those particles, from the spraying section 203 by carrier gas.

The sprayed liquid, or a liquid substance, is gasified so that the inside of the powder passage 202 has a constant gas concentration and the gasified substance is preferably ejected outside the powder passage through the through-hole 221. This makes it possible to keep the concentration of the gasified substance in the powder passage 202 constant and to make the drying speed of the liquid higher than the case where the concentration is not kept constant. Accordingly, it is possible to prevent that the toner particles in which undried liquid is remained are adhered to other toner particles and to further suppress aggregation of the toner particles. As a result, it is possible to further improve yield of the capsule toner with the uniform coating layer.

The concentration of the gasified substance measured by a concentration sensor in a gas exhausting section 222 is preferably around 3% or less. In a case where the concentration of the gasified substance is around 3% or less, the drying speed of the liquid is able to be increased sufficiently, thus making it possible to prevent adhesion of the undried toner base particles in which the liquid is remained to other toner base particles and to prevent aggregation of the toner base particles. Moreover, the concentration of the gasified substance is more preferably 0.1% or more and 3.0% or less. In a case where the spraying speed falls within this range, it is possible to prevent aggregation of the toner base particles without deteriorating the productivity.

The liquid is fed to the spraying section 203 by a liquid feeding pump with a constant flow amount and the liquid sprayed by the spraying section 203 is gasified so that the gasified substance is spread on the surface of the toner base particles and the fine resin particles. Whereby, the toner base particles and the fine resin particles are plasticized.

In the embodiment, spraying is preferably initiated after the surface of the toner base particles and fluidizing rate of the fine resin particles are stabilized in the powder passage 202. This can uniformly spray the liquid to the toner base particles and the fine resin particles. As a result, the yield of a capsule toner having uniform coating layer can be improved.

(Volatile Plasticizer)

In the invention, as the liquid to be sprayed, a volatile plasticizer having an effect of not dissolving but plasticizing the toner base particles and the fine resin particles is used. An example of the volatile plasticizer includes, without particular limitation, an easily volatilized organic solvent such as lower alcohol or acetonitrile. Examples of lower alcohol include methanol, ethanol, propanol, and butanol. When the liquid includes such lower alcohol, it is possible to enhance wettability of the fine resin particles as a coating material with respect to the toner base particles and the fine resin particles are easily adhered over the entire surface or a large part of the toner base particles for further deformation and film-forming. In addition, since lower alcohol has a high vapor pressure, it is possible further shorten the drying time at the time of removing the liquid and to suppress aggregation of the toner base particles.

Further, the viscosity of the liquid is preferably 5 cP or less. The viscosity of the liquid is measured at 25° C., and can be measured, for example, by a cone/plate type rotation viscometer. A preferable example of the liquid having the viscosity of 5 cP or less includes alcohol. Examples of the alcohol include methyl alcohol and ethyl alcohol. These alcohols have the low viscosity and are easily vaporized, and therefore, when the liquid includes the alcohol, it is possible to spray the liquid with a minute droplet diameter without increasing a diameter of the spray droplet of the liquid to be sprayed from the spraying section 203. It is also possible to spray the liquid with a uniform droplet diameter. It is possible to further promote fining of the droplet at the time of collision of the toner base particles and the droplet. This makes it possible to obtain a coated toner having excellent uniformity by uniformly wetting the surfaces of the toner base particles and the fine resin particles with the liquid and applying the liquid to the surfaces of the toner base particles and the fine resin particles and softening the fine resin particles by a multiplier effect with collision energy.

An angle θ formed by the liquid spraying direction which is a direction of the axis of the two-fluid nozzle of the spraying section 203 and the powder flowing direction which is a direction in which the toner base particles and the fine resin particles flow in the powder passage 202 is preferably 0° or more and 45° or less. In a case where the angle θ falls within this range, the droplet of the liquid is prevented from recoiling from the inner wall of the powder passage 202 and yield of the toner base particles coated with the resin film is able to be further improved. In a case where the angle θ exceeds 45°, the droplet of the liquid easily recoils from the inner wall of the powder passage 202 and the liquid is easily retained, thus generating aggregation of the toner particles and deteriorating the yield. Further, a spreading angle Φ of the liquid sprayed by the spraying section 203 is preferably 20° or more and 90° or less. In a case where the spreading angle Φ falls out of this range, it is likely to be difficult to spray the liquid uniformly to the toner base particles.

(3)-4, Film-Forming Step S3*d*

At the film-forming step S3*d*, until the fine resin particles adhering to the toner base particles are softened to form a film, stirring of the rotary stirring section 204 is continued at a predetermined temperature to fluidize the toner base particles and the fine resin particles and form a coating layer, and the capsule toner is obtained.

(3)-5 Collecting Step S3*e*

At the collecting step S3*e*, spraying of the liquid from the spraying section 203 is finished, rotation of the rotary stirring section 204 is stopped, the capsule toner is ejected outside the apparatus from the powder collecting section 207, and the capsule toner is collected.

The configuration of the toner manufacturing apparatus 201 is not limited to the above and various alterations may be added thereto. For example, the temperature regulation jacket may be provided over all the outside of the powder flowing section 209 and the stirring section 208, or may be provided in a part of the outside of the powder flowing section 209 or the stirring section 208. In a case where the temperature regulation jacket is provided over all the outside of the powder flowing section 209 and the stirring section 208, it is possible to prevent the toner base particles from being adhered to the inner wail of the powder passage 202 more reliably.

The toner manufacturing apparatus as described above can be also obtained by combining a commercially available stirring apparatus and the spraying section. An example of the commercially available stirring apparatus provided with a powder passage and a rotary stirring section includes HYBRIDIZATION SYSTEM (trade name) manufactured by Nara Machinery Co., Ltd. By installing a liquid spraying section in the stirring apparatus, the stirring apparatus is usable as the toner manufacturing apparatus for manufacturing a capsule toner of the invention.

(Volatile Plasticizer Content Rate)

A toner of the invention is manufactured by the above-described manufacturing method in which 0.05% by weight or more and 0.70% by weight or less of volatile plasticizer is contained relative to a total amount of a capsule toner. A softening temperature of capsule toner particles is thereby able to be decreased and low temperature fixation property is able to be enhanced. In addition, by using the volatile plasticizer, the plasticizer concentration in the surface layer part of the capsule toner is reduced and aggregation of capsule toner particles is suppressed so that preservation stability is enhanced. Further, when the plasticizer is volatilized on a surface of a toner image after heating and fixation, it is possible to suppress fusion and adhesion of printed matters on a discharge tray and preservation property of a printed image is improved.

As a method for enhancing a volatile plasticizer content rate of toner base particles inside a capsule toner, the above-described spraying step S3*c* is first performed only for the toner base particles, thereafter, in the conventional manner, fine resin particles are added to perform a film-forming step S3*d*. By this method, a capsule toner whose inside toner base particles have a high content rate of the volatile plasticizer is able to be obtained. Further, inside of the toner base particles is impregnated with the volatile plasticizer at the first spraying step, thus relatively uniform swelling is made for the surface of the toner base particles by the volatile plasticizer, and more uniform film-forming of the fine resin particles is achieved at the film-forming step.

<Calculation Method of a Volatile Plasticizer Content Rate>

A volatile plasticizer content of the capsule toner of the invention was measured by using a headspace GO method, and volatile plasticizer content of a toner was determined quantity by a calibration curve constructed by using toluene.

A 500-mg capsule toner or toluene is weighed with a measurement container (vial container:22 ml) and sealing is made by a crimp cap and a septum using a crimper. A septum, with Teflon (registered trade mark) coating, was used for preventing the swelling caused by the volatile plasticizer. A vial sealed was set at a headspace sampler and a volatile component that was generated from a sample in the following conditions was analyzed by gas chromatography.

Note that, to deduct the volatile component from a septum and the like from a measurement value, a value that an empty vial container was similarly measured was a blank value, and a volatile component-derived peak area value that was obtained by the measurement was corrected.

[Measurement Conditions]

Apparatus: headspace sampler; HEWLETT PACKARD 7694

Oven temperature:120° C.

Heating time of the sample:60 minutes

Sample loop (Ni):1 ml

Loop temperature:170° C.

Transfer line temperature:190° C.

Pressure time:0.50 minute

LOOP FILL TIME:0.01 minute

LOOP EQ TIME:0.05 minute

INJECT TIME:1.00 minute

GC cycle time:80 minutes

Carrier gas: He

GC; HEWLETT PACKARD 6890GC (detector: FID)

Column: HP-1 (inner diameter 0.25 μm×30 m)

Carrier gas: He

Oven: Holding for 20 minutes at 35° C., rising a temperature to 300° C. at 20° C./minute, and holding for 20 minutes

INJ:300° C.

DET:320° C.

Splitless, constant pressure (20 psi) mode

[Construction of Calibration Curve]

Some samples that only toluene is weighed in a vial container are prepared for analyzing respectively in the above-described conditions and a calibration curve is constructed for toluene mass weighed and a toluene-derived peak area value that was obtained by measurement.

The calibration curve is used for obtaining volatile plasticizer mass which is converted to toluene from the peak area value, regarding a volatile plasticizer-derived peak that is generated from a capsule toner as a toluene peak. The mass obtained in this manner is divided by 500 mg as capsule toner mass provided for analysis, thus a rate of a volatile plasticizer component that is contained in the capsule toner is obtained.

As mentioned above, the content rate of the volatile plasticizer in the capsule toner was calculated.

2. Toner

The toner of the invention is manufactured by the above-described manufacturing method in which 0.05% by weight or more and 0.70% by weight or less of volatile plasticizer is contained relative to a total amount of the capsule toner. A softening temperature of capsule toner particles is thereby able to be decreased and low temperature fixation property is able to be enhanced. In addition, by using the volatile plasticizer, the plasticizer concentration in the surface layer part of the capsule toner is reduced and aggregation of capsule toner particles is suppressed so that preservation stability is enhanced. Further, when the plasticizer is volatilized on a surface of a toner image after heating and fixation, it is possible to suppress fusion and adhesion of printed matters on a discharge tray and preservation property of a printed image is improved.

To the capsule toner of the invention, an external additive may be added. As the external additive, heretofore known substances can be used including silica and titanium oxide. It is preferred that these substances be surface-treated with silicone resin and a silane coupling agent. A preferable usage of the external additive is 1 part by weight to 10 parts by weight based on 100 parts by weight of the toner.

3. Developer

A developer according to an embodiment of the invention includes the capsule toner according to the embodiment. This makes it possible that a developer has uniform toner characteristics such as charging characteristics between individual toner particles, thus obtaining a developer capable of maintaining excellent development performance. The developer of the embodiment can be used in form of either one-component developer or two-component developer.

In the case where the developer is used in form of one-component developer, only the capsule toner is used without carriers. A blade and a fur brush are used to effect the fictional electrification at a developing sleeve so that the toner is attached onto the sleeve, thereby conveying the toner to perform image formation.

In the case where the developer is used in form of two-component developer, the capsule toner of the embodiment is used together with a carrier.

(Carrier)

As the carrier, heretofore known substances can be used including, for example, single or complex ferrite composed of iron, copper, zinc, nickel, cobalt, manganese, and chromium; a resin-coated carrier having carrier core particles whose surfaces are coated with coating substances; or a resin-dispersion carrier in which magnetic particles are dispersed in resin.

As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder. In addition, the resin used for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. Those substances and resin listed above may be used each alone, and two or more thereof may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the volume resistivity of the carrier is preferably $10^8$ Ω·cm or more, and more preferably $10^{12}$ Ω·cm or more.

The volume resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state of the image bearing member with the toner in the non-contact development and to possibly cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$ to 8 $g/cm^2$) as an example, the usage of the toner may be determined such that a content of the toner in the developer is 2% by weight to 30% by weight and preferably 2% by weight to 20% by weight of the total amount of the developer. Further, coverage of the carrier with the toner is preferably 40% to 80%.

4. Image Forming Apparatus

Figure 5:
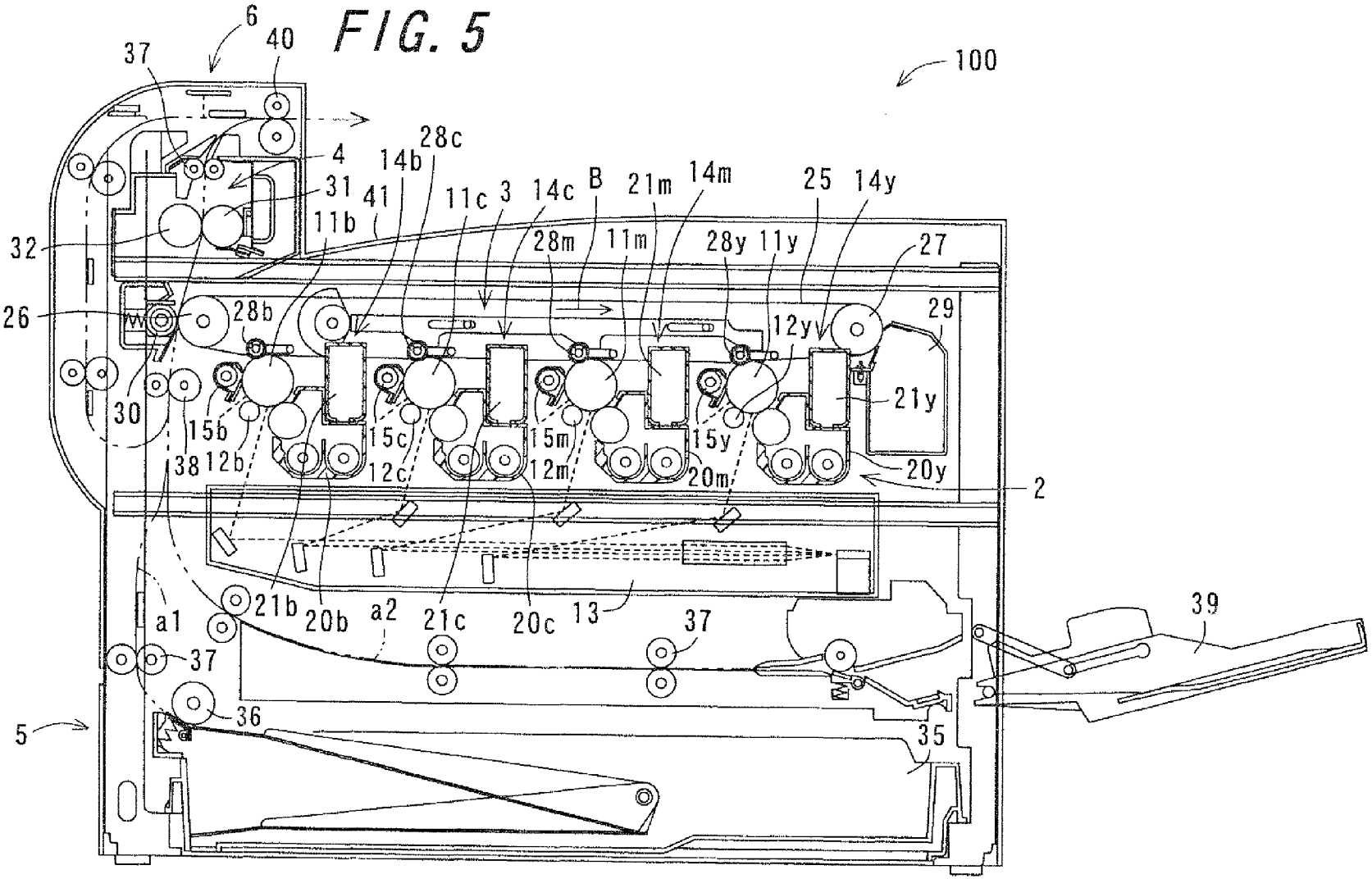
FIG. 5 is a view showing a configuration of the image forming apparatus according to the embodiment of the invention.

FIG. 5 is a sectional view schematically showing a configuration of an image forming apparatus 100 according to a fourth embodiment of the invention. The image forming apparatus 100 is a multifunctional system which combines a copier function, a printer function, and a facsimile function. In the image forming apparatus 100, according to image information transmitted thereto, a full-color or black-and-white image is formed on a recording medium. To be specific, three print modes, i.e., a copier mode (copying mode), a printer mode, and a facsimile mode are available in the image forming apparatus 100, one of which print modes is selected by a control unit (not shown) in response to an operation input given by an operating section (not shown) or a print job given by a personal computer, a mobile computer, an information record storage medium, or an external equipment having a memory unit.

The image forming apparatus 100 includes a photoreceptor drum 11, a toner image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The photoreceptor drum 11 is a roller-like member provided so as to be capable of rotationally driving around an axis by a rotary driving section (not shown) and on the surface of which an electrostatic latent image is formed. The rotary driving section of the photoreceptor drum 11 is controlled by a controlling unit with a central processing unit (CPU). The photoreceptor drum 11 is comprised of a conductive substrate (not shown) and a photosensitive layer (not shown) formed on the surface of the conductive substrate.

The conductive substrate may be various shapes including a cylindrical shape, a columnar shape, or a thin film sheet shape, for example. Among them, the cylindrical shape is preferable. The conductive substrate is formed by a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, and the like, is formed on a film-like substrate such as a synthetic resin film, a metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, and the like, are preferred.

The photosensitive layer is formed, for example, by stacking a charge generating layer and a charge transporting layer on a surface of the conductive substrate. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the top layer.

The charge generating layer contains as a main substance a charge generating substance that generates charges under irradiation of light, and optionally contains known binder resin, plasticizer, sensitizer, and the like. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination.

The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resin may be used each alone or optionally two or more of them may be used in combination.

A charge generating layer can be formed by preparing a coating solution for charge generating layer containing the above-described components (a charge generating substance, a binder resin, and as necessary, plasticizer, sensitizer and the like) to coat a conductive substrate surface therewith, followed by drying. When the coating solution for charge generating layer is prepared, each component is dissolved or dispersed in an appropriate organic solvent.

The film thickness of a charge generating layer which is formed in this manner is not particularly limited, however, preferably is 0.05 μm or more and 5 μm or less, and more preferably 0.1 μm or more and 2.5 μm or less.

The charge transporting layer stacked over the charge generating layer contains as essential substances a charge transporting substance having an ability of receiving and transporting charges generated from the charge generating substance, and a binder resin for charge transporting layer, and optionally contains known antioxidant, plasticizer, sensitizer, lubricant, and the like. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cicinnoline derivative, a phenazine oxide derivative, tetracyanoethylene, tetracyanoquinodimethane, bromanil, chloranil, and benzoquinone.

The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film-forming property, and the wear resistance, an electrical property and the like of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. Also for the antioxidant, substances used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer.

A charge transporting layer can be formed by preparing a coating solution for charge transporting layer containing the above-described components (a charge transporting substance, a binder resin, and as necessary, oxidant, plasticizer, sensitizer and the like) to coat the charge generating layer surface therewith, followed by drying. When the coating solution for charge transporting layer is prepared, each component is dissolved or dispersed in an appropriate organic solvent. The film thickness of the charge transporting layer which is formed in this manner is not particularly limited, however, preferably is 10 μm or more and 50 μm or less, and more preferably 15 μm or more and 40 μm or less.

Further, it is also possible to form a photosensitive layer in which a charge generating substance and a charge transporting substance are present in one layer. In this case, the kind and content of the charge generating substance and the charge transporting substance, the kind of the binder resin, other additives and the like may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The image forming section 2 includes a charging device 12, an exposure unit 13, a developing device 14, and a cleaning unit 15. The charging device 12 and the exposure unit 13 functions as a latent image forming section. The charging device 12, the developing device 14, and the cleaning unit 15 are disposed in the order just stated around the photoreceptor drum 11. The charging device 12 is disposed vertically below the developing device 14 and the cleaning unit 15.

In the toner image forming section 2, signal light corresponding to the image information is emitted from the exposure unit 13 to the surface of the photoreceptor drum 11 which has been evenly charged by the charging device 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

The charging device 12 is a device for charging the surface of a photoreceptor drum 11 to predetermined polarity and potential. As the charging device 12, it is possible to use a charging brush type charger, a charger type charger, a saw tooth type charger or an ion-generating apparatus and the like. Although in the embodiment, the charging device 12, facing the photoreceptor drum 11, is disposed away from the surface of the drum along a longitudinal direction of the drum, the configuration is not limited thereto. For example, a charging roller may be used as the charging device 12, and the charging roller may be disposed in contact-pressure with the photoreceptor drum while a contact-charging type charger such as a charging brush or a magnetic brush may be used.

The exposure unit 13 is disposed so that a light beam corresponding to each color emitted from the exposure unit 13 passes between the charging section 12 and the developing device 14 and reaches the surface of the photoreceptor drum 11. In the exposure unit 13, the image information is converted into light beams corresponding to each color of black, cyan, magenta, and yellow, and the surface of the photoreceptor drum 11 which has been evenly charged by the charging device 12, is exposed to the light beams corresponding to each color to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array or a unit in which a liquid-crystal shutter and a light source are appropriately combined with each other.

Figure 6:
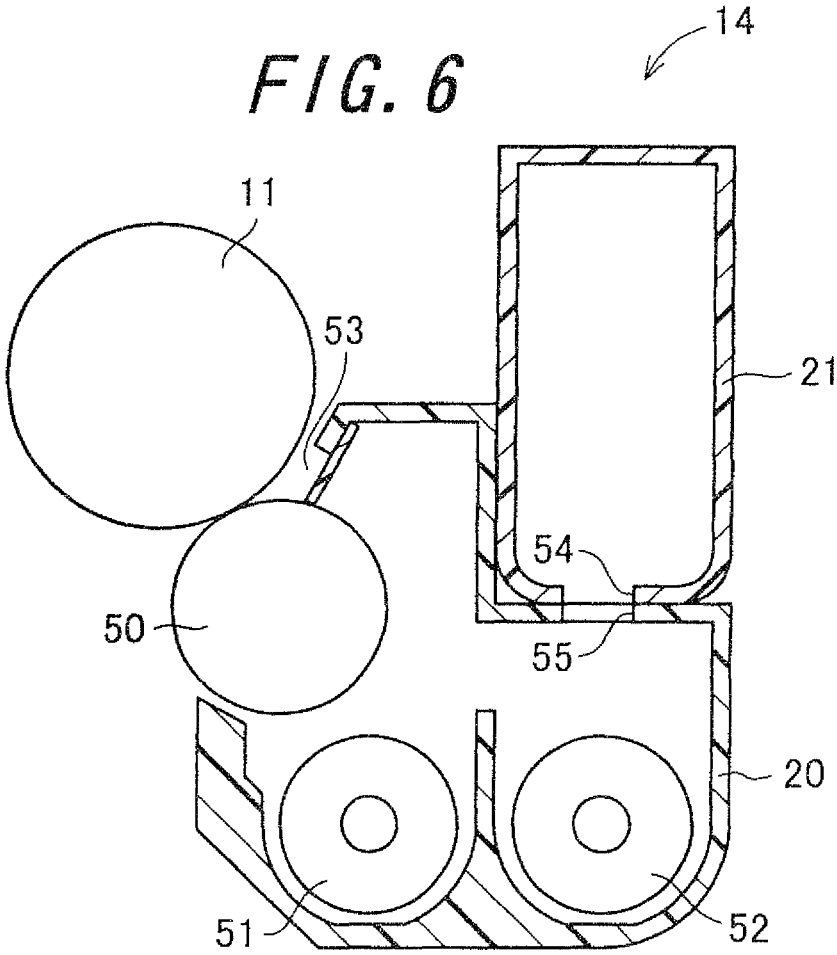
FIG. 6 is a schematic view schematically showing the developing device shown in FIG. 5.

FIG. 6 is a schematic view schematically showing the developing device 14 provided in the image forming apparatus 100 shown in FIG. 5. The developing device 14 includes a developing tank 20 and a toner hopper 21.

The developing tank 20 is a container-shaped member which is disposed so as to face the surface of the photoreceptor drum 11 and used to supply a toner to an electrostatic latent image formed on the surface of the photoreceptor drum 11. The developing tank 20 contains in an internal space thereof the toner, and rotatably supports roller members such as a developing roller 50, a supplying roller 51, and an agitating roller 52. Moreover, a screw member may be stored instead of the roller-shaped member. The developing device 14 of this embodiment stores the toner of the above one embodiment in the developing tank 20 as a toner.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact portion or most-adjacent portion between the developing roller 50 and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image, or toner attachment amount for the electrostatic latent image, can be controlled by changing a value of the development bias voltage.

The supplying roller 51 is a roller-shaped member which is rotatably disposed facing the developing roller 50 and supplies the toner to the vicinity of the developing roller 50. The agitating roller 52 is a roller-shaped member which is rotatably disposed facing the supplying roller 51 and the toner which is newly supplied from a toner hopper 21 into the developer tank 20 is fed to the vicinity of the supplying roller 51. The toner hopper 21 is disposed so as to communicate a toner replenishment port 54 provided in a lower part in a vertical direction thereof, with a toner reception port 55 provided in an upper part in a vertical direction of the developer tank 20, and replenishes the developer tank 20 with the toner according to toner consumption situation thereof. Additionally, the developing device 14 may be configured so as to replenish the toner directly from a toner cartridge of each color without using the toner hopper 21.

As described above, since the developing device 14 develops a latent image using the developer of the invention, it is possible to stably form a high-definition toner image on the photoreceptor drum 11. As a result, it is possible to form a high-quality image stably.

The cleaning unit 15, after a toner image formed on the surface of the photoreceptor drum 11 has been transferred to the recording medium by the developing device 14, removes the toner which remains on the surface of the drum and cleans the surface of the photoreceptor drum 11. For the cleaning unit 15, for example, a plate-like member such as a cleaning blade is used. In the image forming apparatus of the embodiment, an organic photoreceptor drum is used as the photoreceptor drum 11. A surface of the organic photoreceptor drum contains a resin component as a main ingredient and therefore the surface deteriorates easily by chemical action of ozone which is generated by corona discharging of the charging device. The deteriorated surface part is, however, worn away by abrasion action through the cleaning unit 15 and thus removed reliably, though gradually. Accordingly, the problem of the surface deterioration caused by ozone and the like is solved, and it is possible to stably maintain the potential of charges given by the charging operation over a long period of time. Although the cleaning unit 15 is provided in the embodiment, the cleaning unit 15 may not particularly be provided.

The transfer section 3 is disposed above the photoreceptor drum 11 and includes the intermediate transfer belt 25, a driving roller 26, a driven roller 27, four intermediate transferring rollers 28(*b, c, m, y*) respectively corresponding to image information on each color of black, cyan, magenta, and yellow, a transfer belt cleaning unit 29, and a transferring roller 30.

In the transfer section 3, the toner image is transferred from the photoreceptor drum 11 onto the intermediate transfer belt 25 in the pressure-contact portion between the photoreceptor drum 11 and the intermediate transferring roller 28, and the transferred toner image is conveyed to the transfer nip region where the toner image is transferred onto the recording medium.

The intermediate transfer belt 25 is an endless belt-shaped member that is supported around the driving roller 26 and the driven roller 27 with tension, thereby forming a loop-shaped travel path, rotating in an arrow B direction. The driving roller 26 is, by a driving section (not shown), rotatably provided around an axis thereof and rotation thereof rotates the intermediate transfer belt 25 in the arrow B direction. The driven roller 27 is provided so as to be driven to rotate by the rotation of the driving roller 26, and imparts constant tension so that the intermediate transfer belt 25 does not go slack. The intermediate transferring roller 28 is disposed in pressure-contact with the photoreceptor drum 11 with the intermediate transfer belt 25 interposed therebetween so as to rotate around an axis thereof by a driving section shown). Additionally, the intermediate transferring roller 28 is connected to a power source (not shown) for applying the transfer bias voltage as described above to transfer the toner image on the surface of the photoreceptor drum 11 to the intermediate transfer belt 25.

When the intermediate transfer belt 25 passes by the photoreceptor drum 11 in contact therewith, potential whose polarity is opposite to the polarity of the charged toner on the surface of the drum is applied as the transfer bias voltage from the intermediate transferring roller 28, and the toner image is transferred from the surface of the photoreceptor drum 11 onto the intermediate transfer belt 25. The transferred toner image is conveyed by the intermediate transfer belt 25 rotating in the arrow B direction to a transfer nip region where transferring onto the recording medium is performed. In the case of a full-color toner image, toner image of each color that is formed by each photoreceptor drum 11 is transferred by stacking to the intermediate transfer belt 25, thereby a full-color toner image is formed.

The transfer belt cleaning unit 29 is disposed opposite to the driven roller 27 with the intermediate transfer belt 25 interposed therebetween so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25.

The transferring roller 30 is disposed in pressure-contact with the driving roller 26 through the intermediate transfer belt 25 interposed therebetween, and capable of rotating around its own axis by a driving section (not shown). In a pressure-contact portion (a transfer nip region) between the transferring roller 30 and the driving roller 26, a toner image which has been borne by the intermediate transfer belt 25 and thereby conveyed to the pressure-contact portion is transferred onto a recording medium fed from the later-described recording medium feeding section 5. The recording medium bearing the toner image is fed to the fixing section 4.

The fixing section 4 is provided downstream of the transfer section 3 along a conveyance direction of the recording medium, and contains a fixing roller 31 and a pressure roller 32.

When the recording medium to which the toner image is transferred in the transfer section 3 passes through a fixing nip region nipped by the fixing roller 31 and the pressure roller 32 by the fixing section 4, the toner image is heated and pressed and thereby is fixed on the recording medium, and an image is formed.

The fixing roller 31 is rotatably disposed by a driving section (not shown), and heats and fuses the toner.

Inside the fixing roller 31 is provided a heating portion (not shown). The heating portion heats the heating roller 31 so that a surface of the heating roller 31 has a predetermined temperature (hereinafter, occasionally referred to as "heating temperature"). For the heating portion, a heater, a halogen lamp, and the like device can be used, for example. The heating portion is controlled by a fixing condition control section.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit.

The pressure roller 32 is disposed in pressure-contact with the fixing roller 31, and supported so as to be driven to rotate by the rotation of the fixing roller 31. The pressure roller 32 fixes the toner image onto the recording medium in cooperation with the fixing roller 31. At this time, the pressure roller 32 assists in the fixation of the toner image onto the recording medium by pressing the toner in a fused state due to heat from the fixing roller 31, against the recording medium. The pressure-contact portion between the fixing roller 31 and the pressure roller 32 is a fixing nip region.

The recording medium feeding section 5 includes an automatic paper feed tray 35, a pickup roller 36, conveying rollers 37, registration rollers 38, and a manual paper feed tray 39. By the recording medium feeding section 5, the recording medium fed sheet by sheet from the automatic paper feed tray 35 or the manual paper feed tray 39 is fed to the transfer nip region in synchronization with the conveyance of the toner image borne on the intermediate transfer belt 25 to the transfer nip region. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path a1. The conveying rollers 37 are a pair of roller members disposed in pressure-contact with each other, and convey the recording medium for the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region. The manual paper feed tray 39 is a device for taking the recording mediums into the image forming apparatus 100, and recording mediums stored in the manual paper feed tray 39 are different from the recording mediums stored in the automatic paper feed tray 35 and have any size. The recording medium taken in from the manual paper feed tray 39 passes through a paper conveyance path a2 by use of the conveying rollers 37, thereby being fed to the registration rollers 38.

The discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion.

To the memory portion are inputted, for example, various set values obtained by way of an operation panel (not shown) disposed on the upper surface of the image forming apparatus 100, results detected from a sensor (not shown) and the like disposed in various portions inside the image forming apparatus 100, and image information obtained from an external equipment. Further, programs for operating various functional elements are written. Examples of the various functional elements include a recording medium determining section, an attachment amount controlling section, and a fixing condition controlling section. For the memory portion, those customarily used in the relevant filed can be used including, for example, a read only memory (ROM), a random access memory (RAM), and a hard disk drive (HDD). For the external equipment, it is possible to use electrical and electronic devices which can form or obtain the image information and which can be electrically connected to the image forming apparatus 100. Examples of the external equipment include a computer, a digital camera, a television receiver, a video recorder, a DVD recorder, an HD DVD, a Blu-ray disc recorder, a facsimile machine, and a mobile computer.

The computing portion takes out the various data (such as an image formation order, the detected result, and the image information) written in the memory portion and the programs for various functional elements, and then makes various determinations. The control portion sends a control signal to a relevant device in accordance with the result determined by the computing portion, thus performing control on operations.

The control portion and the computing portion include a processing circuit which is achieved by a microcomputer, a microprocessor, and the like having a central processing unit (CPU). The control unit contains a main power source as well as the above-stated processing circuit. The power source supplies electricity to not only the control unit but also respective devices provided inside the image forming apparatus 100.

EXAMPLES

Hereinafter, referring to examples and comparative examples, the invention will be specifically described. In the following description, unless otherwise noted, "parts" and "%" represent "parts by weight" and "% by weight" respectively. In the examples and the comparative examples, a glass transition temperature of the binder resin and the toner base particles, a softening temperature of the binder resin, a melting point of the release agent, and a volume average particle size of the toner base particles were measured as follows.

[Glass Transition Temperature of Binder Resin and Toner Base Particle]

Using a differential scanning calorimeter (trade name: DSC220, manufactured by Seiko Instruments & Electronics Ltd.), 1 g of specimen was heated at a temperature increasing rate of 10° C./min to measure a USC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition temperature ($T_g$).

[Softening Temperature of Binder Resin]

Using a flow characteristic evaluation apparatus (trade name: FLOW TESTER OFT-100C, manufactured by Shimadzu Corporation), 1 g of specimen was heated at a temperature increasing rate of 6° C./min, under load of 20 kgf/cm$^2$ ($19.6\times10^5$ Pa) so that the specimen was pushed out of a dye (nozzle opening diameter of 1 mm and length of 1 mm) and a temperature at the time when a half of the specimen had flowed out of the dye was obtained as the softening temperature ($T_m$).

[Melting Point of Release Agent]

Using the differential scanning calorimeter (trade name: DSC220, manufactured by Seiko instruments & Electronics Ltd.), 1 g of specimen was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume Average Particle Size]

To 50 ml of electrolyte (trade name: ISOTON-II, manufactured by Beckman Coulter, Inc.), 20 mg of specimen and 1 ml of sodium alkylether sulfate were added, and a thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a specimen for measurement. The measurement sample was analyzed by a particle size distribution-measuring device: MULTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

Example 1

Production of Toner Base Particles

| | |
|---|---|
| Polyester resin (trade name: DIACRON, manufactured by Mitsubishi Rayon Co., Ltd., glass transition temperature of 55° C., softening temperature of 130° C.) | 87.5% (100 parts) |
| C.I. Pigment Blue 15:3 | 5.0% (5.7 parts) |
| Release Agent (Carnauba Wax, melting point of 82° C.) | 6.0% (6.9 parts) |
| Charge Control Agent (trade name: Bontron E84, Orient Chemical Industries, Ltd.) | 1.5% (1.7 parts) |

After pre-mixing the materials described above by a Henschel mixer (trade name: FM20C, manufactured by Mitsui Mining Co., Ltd.), the obtained mixture was melt and kneaded by a twin-screw extruder (trade name: PCM65 manufactured by Ikegai, Ltd.) After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to prepare toner base particles with a volume average particle size of 6.5 μm and a glass transition temperature of 56° C.

[Preparation of Fine Resin Particles]

A polymer obtained by polymerizing styrene and butyl acrylate was freeze-dried. Thus, styrene/butyl acrylate copolymer fine particles (glass transition temperature: 74° C., softening temperature:124° C.) having a volume average particle size of 0.15 were obtained as the fine resin particles.

[Capsulation of Toner]

By an apparatus in which a two-fluid nozzle is installed in Hybridization system (trade name: NHS-1 Model, manufactured by Nara Machinery Co., Ltd.) in accordance with the apparatus shown in FIG. 2, ethanol was sprayed in a state where toner base particles and fine resin particles were stirred and fluidized. For a liquid spraying unit, the one that is connected so as to feed the liquid quantitatively to the two-fluid nozzle 1 through a liquid feeding pump (trade name: SP11-12, manufactured by FLOM Co., Ltd.) is usable. The spraying speed of the liquid and the exhausting speed of the liquid gas can be observed with a commercially available gas detector (product name: XP-3110, manufactured by New Cosmos Electric Co., Ltd.).

The temperature regulation jacket was provided over the entire surface of the powder flowing section and the wall surface of the stirring section. A temperature sensor was installed in the powder passage so that a temperature of the powder flowing section and the stirring section became 55° C. In the above-described apparatus, a peripheral speed in the outermost peripheral of the rotary stirring section was 100 m/sec at the fine resin particle adhering step to the surface of toner base particles. The peripheral speed was also 100 m/sec at the spraying step and the film-forming step. Moreover, an installation angle of the two-fluid nozzle was set so that an angle formed by the liquid spraying direction and the powder flowing direction (hereinafter referred to as "spraying angle") is in parallel (0°).

After stirring and mixing 100 parts by weight of toner base particles and 10 parts by weight of fine resin particles which were thus prepared for five minutes by the apparatus, ethanol (boiling point:78.3° C.) was sprayed for thirty minutes at spraying speed of 1.0 g/min and an air flow of 5 L/min to film-form the fine resin particles on the surface of the toner base particles. Then, spraying of the ethanol was stopped, followed by stirring for twenty minutes, to obtain a capsule toner. In this case, an exhaust concentration of the gasified substance exhausted through the through-hole and the gas exhausting section was stable at about 2.8 Vol %. Moreover, the air flow into the apparatus was 10 L/min in total with the air flow from the two-fluid nozzle by adjusting the air flow from the rotary shaft section into the apparatus to 5 L/min.

Example 2

A toner of Example 2 was obtained in the same manner as Example 1 except for that the stirring time after stopping spraying of ethanol was 15 minutes at the step of encapsulating a toner.

Example 3

A toner of Example 3 was obtained in the same manner as Example 1 except for that the stirring time after stopping spraying of ethanol was 10 minutes at the step of encapsulating a toner.

Example 4

A toner of Example 4 was obtained in the same manner as Example 1 except for that the stirring time after stopping spraying of ethanol was 5 minutes at the step of encapsulating a toner.

Example 5

At the step of encapsulating a toner of Example 1, the toner base particles and the fine resin particles were not mixed, and first, only the toner base particles were sprayed with ethanol at spraying speed of 0.9 g/min and impregnated therewith, followed by stirring for five minutes after stopping spraying of ethanol, thus toner base particles impregnated with ethanol were produced.

A toner of Example 5 was obtained in the same manner as Example 1 except for that the toner base particles impregnated with ethanol were used and the stirring time after stopping spraying of ethanol was 10 minutes.

Example 6

At the step of encapsulating a toner of Example 1, the toner base particles and the fine resin particles were not mixed, and first, only the fine resin particles were sprayed with ethanol at spraying speed of 0.1 g/min and impregnated therewith, followed by stirring for five minutes after stopping spraying of ethanol, thus fine resin particles impregnated with ethanol were produced.

A toner of Example 6 was obtained in the same manner as Example 1 except for that the fine resin particles impregnated with ethanol was used and the stirring time after stopping spraying of ethanol was 10 minutes.

Example 7

A toner of Example 7 was obtained in the same manner as Example 1 except for that n-propanol (boiling point: 82.4° C.) was used instead of ethanol at the step of encapsulating a toner.

Example 8

A toner of Example 8 was obtained in the same manner as Example 1 except for that iso-propanol (boiling point: 97.2° C.) was used instead of ethanol at the step of encapsulating a toner.

Example 9

A toner of Example 9 was obtained in the same manner as Example 2 except for that methanol (boiling point: 64.7° C.) was used instead of ethanol at the step of encapsulating a toner.

Comparative Example 1

A toner of Comparative Example 1 was obtained in the same manner as Example 1 except for that the stirring time after stopping spraying of ethanol was 25 minutes.

Comparative Example 2

A toner of Comparative Example 2 was obtained in the same manner as Example 1 except for that the stirring time after stopping spraying of ethanol was 3 minutes.

Comparative Example 3

A toner of Comparative Example 3 was obtained in the same manner as Example 1 except for that ethanol was not used at all at the step of encapsulating a toner.

Comparative Example 4

A toner of Comparative Example 4 was obtained in the same manner as Example 1 except for that toluene (boiling point:110.6° C.) was used instead of ethanol.

Table 1 collectively shows configuration and a content rate of alcohol of Examples 1 to 9 and Comparative Examples 1 to 4.

TABLE 1

| Example | Glass transition temperature (° C.) Core | Shell | Particle size (μm) Toner | Drying (min) | Alcohol Type | Content rate |
|---|---|---|---|---|---|---|
| Example 1 | 56 | 74 | 6.5 | 20 | ethanol | 0.05% |
| Example 2 | 56 | 74 | 6.4 | 15 | ethanol | 0.12% |
| Example 3 | 56 | 74 | 6.7 | 10 | ethanol | 0.31% |
| Example 4 | 56 | 74 | 6.8 | 5 | ethanol | 0.68% |
| Example 5 | 56 | 74 | 6.6 | 5/10 | ethanol | 0.21% |
| Example 6 | 56 | 74 | 6.9 | 5/10 | ethanol | 0.15% |
| Example 7 | 56 | 74 | 6.7 | 20 | n-propanol | 0.09% |
| Example 8 | 56 | 74 | 6.8 | 20 | iso-propanol | 0.07% |
| Example 9 | 56 | 74 | 6.4 | 15 | methanol | 0.08% |
| Comparative Example 1 | 56 | 74 | 6.4 | 25 | ethanol | 0.03% |
| Comparative Example 2 | 56 | 74 | 6.9 | 3 | ethanol | 0.85% |
| Comparative Example 3 | 56 | 74 | 6.1 | — | — | — |
| Comparative Example 4 | 56 | 74 | — | — | toluene | — |

Various evaluations were performed as follows as to the toners obtained by Examples 1 to 9 and Comparative Examples 1 to 4.

<Fixation Property>

A fixed image was produced by using a remodeled one of a commercially-available copier (trade name: MX-2300G, manufactured by Sharp Corporation). First, on recording paper (trade name: PPC paper SF-4AM3, manufactured by Sharp Corporation) that is a recording medium, a sample image including a solid image section (rectangle of 20 mm long and 50 mm wide) was formed as an unfixed image. At this time, adjustment was performed so that an adhering amount of a toner of the solid image section to the recording paper was 0.5 mg/cm$^2$. Next, the fixed image was produced by using an external fuser utilizing a fixing section of a color multi-functional peripheral. Fixing process speed was 220 mm/sec, a temperature of a fixing roller was increased from 110° C. in steps of 5° C., a temperature width in which neither low-temperature offset nor high-temperature offset appears was measured, and the temperature width between an upper limit and a lower limit was a fixing non-offset region. The lower limit temperature of the fixing non-offset region and the fixing non-offset region were evaluated based on the following criteria.

(Evaluation 1)

Good: The lower limit of the fixing non-offset region is lower than 130° C.

Not bad: The lower limit of the fixing non-offset region is 130° C. or higher and lower than 140° C.

Poor: The lower limit of the fixing non-offset region is 140° C. or higher.

(Evaluation 2)

Good: The fixing non-offset region is 60° C. or higher.

Not bad: The fixing non-offset region is 50° C. or higher and lower than 60° C.

Poor: The fixing non-offset region is lower than 50° C.

Putting together the above two evaluations, fixation property was determined.

(Determination)

Excellent: Both the evaluations are rated as "Good".

Good: One of the evaluations is rated as "Good", and the other is rated as "Not bad".

Not bad: Both the evaluations are rated as "Not bad".

Poor: At least the either evaluation is rated as "Poor".

<Preservation Stability>

The preservation stability was evaluated depending on presence/absence of an aggregate after high-temperature preservation using the toners of the examples and the comparative examples. After 20 g of toners were sealed in a plastic container and have been left for forty-eight hours at 50° C., the toners were taken out and screened out through a 230-mesh sieve. The weight of the toners remaining on the sieve was measured and a ratio of the weight to the total weight of the toners was represented as the remaining amount to perform the evaluation based on the following criteria. The lower value shows that the toner is not blocked and preservation property is excellent.

Good: The toner remaining amount is less than 1.5%.

Not bad: The toner remaining amount is 1.5% or more and less than 3.0%.

Poor: The toner remaining amount is 3.0% or more.

<Comprehensive Evaluation>

A comprehensive evaluation was conducted for the toner of the invention and the method for manufacturing thereof based on the determination of the fixation property and the evaluation of the preservation stability above. Comprehensive evaluation criteria were as follows:

Excellent: Very favorable. The fixation property is rated as "Excellent", and the preservation stability is rated as "Good".

Good: Favorable. Both thereof are rated as "Good".

Not bad: Fair. Neither is rated as "Poor", and at least either is rated as "Not bad".

Poor: No good. At least either is rated as "Poor".

Table 2 shows the evaluation results and the comprehensive evaluation results of the toners obtained by Examples 1 to 9 and Comparative Examples 1 to 4.

TABLE 2

| Example | Fixation region Upper limit (° C.) | Lower limit (° C.) | Temperature width (° C.) | Fixation property Evaluation 1 | Evaluation 2 | Determination | Preservation stability | Comprehensive evaluation |
|---|---|---|---|---|---|---|---|---|
| Example 1 | 200 | 135 | 65 | Not bad | Good | Good | Good | Good |
| Example 2 | 195 | 130 | 65 | Not bad | Good | Good | Good | Good |
| Example 3 | 180 | 125 | 55 | Good | Not bad | Good | Good | Good |
| Example 4 | 175 | 120 | 55 | Good | Not bad | Good | Not bad | Not bad |
| Example 5 | 190 | 120 | 70 | Good | Good | Excellent | Good | Excellent |
| Example 6 | 170 | 120 | 50 | Good | Not bad | Good | Not bad | Not bad |
| Example 7 | 190 | 130 | 60 | Not bad | Good | Good | Good | Good |
| Example 8 | 195 | 135 | 60 | Not bad | Good | Good | Good | Good |
| Example 9 | 190 | 135 | 55 | Not bad | Not bad | Not bad | Good | Not bad |
| Comparative Example 1 | 200 | 140 | 60 | Poor | Good | Poor | Good | Poor |
| Comparative Example 2 | 155 | 115 | 40 | Good | Poor | Poor | Poor | Poor |
| Comparative Example 3 | 170 | 140 | 30 | Poor | Poor | Poor | Poor | Poor |
| Comparative Example 4 | — | — | — | — | — | — | — | — |

In Examples 1 to 4, since ethanol was contained in a predetermined range in the capsule toners, the low temperature fixation property and the preservation stability were able to be enhanced.

In Example 5, although an ethanol content rate in the capsule toner was 0.21%, since the toner base particles had been impregnated with ethanol in advance, it is considered that more ethanol is present in the toner base particles inside than in the coating layer outside. Therefore, it is considered that the low temperature fixation property is excellent and at the same time, the preservation stability is also high.

In Example 6, since the fine resin particles to be a coating layer had been impregnated with ethanol in advance, it is considered that more ethanol is present in the coating layer outside than in the toner base particles inside the capsule toner. Therefore, it is considered that even though the fixation temperature of the toner is decreased, the preservation stability is not very good.

In Examples 7 and 8, although n-propanol and iso-propanol were used, respectively, instead of ethanol at the step of encapsulating a toner, the same effects as when ethanol was used, were able to be obtained for both the low temperature fixation property and the preservation stability.

In Comparative Example 1, since the drying time was long and an ethanol content rate in the capsule toner was low, even though the preservation stability was good, the low temperature fixation property had an insufficient result.

In Comparative Example 2, since the drying time was short and an ethanol content in the capsule toner was high, the result was that, even though the lower limit of a fixation region was low, the preservation stability was poor.

In Comparative Example 3, plasticizer was not used at all, and both the low temperature fixation property and the preservation stability attained insufficient results. As a cause for the narrowed fixation region, it is considered that a temperature of a lower limit did not decrease since the plasticizer was not contained. In addition, since the coating layer was not formed uniformly, wax leaked to the surface of the toner due to heat, and the preservation stability decreased.

In Comparative Example 4, although non-volatile plasticizer was used, fusion and adhesion of the toner particles were strong, and the capsule toner particles were not formed. As a cause therefor, it is considered that when toluene is mixed with toner resin, volatility extremely decreases. It is, therefore, considered that a large amount of toluene as plasticizer was absorbed into the toner particles, the toner particles were excessively softened, and aggregation occurred.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A capsule toner comprising:

toner particles having toner base particles including styrene-acrylic resin or polyester resin as a binder resin, and a coating layer including styrene-acrylic resin or polyester resin, for coating a surface of the toner base particles, 0.05% by weight or more and 0.70% by weight or less of volatile plasticizer being contained based on a total amount of the capsule toner;

wherein the volatile plasticizer is an alcohol whose boiling point is 78° C. or higher and 98° C. or lower.

2. The capsule toner of claim 1, wherein the volatile plasticizer is ethanol.

3. A two-component developer comprising the capsule toner of claim 1 and a carrier having magnetism.

* * * * *